US011643829B2

(12) United States Patent
Lechner

(10) Patent No.: US 11,643,829 B2
(45) Date of Patent: May 9, 2023

(54) APPARATUS AND METHOD FOR THE ONE-PIECE PRODUCTION OF A ROOM MODULE HAVING THREE SIDE ELEMENTS AND A FLOOR ELEMENT AND/OR A CEILING ELEMENT, AND ROOM MODULE OF THIS TYPE

(71) Applicant: LECHNER GROUP GMBH, Frankfurt am Main (DE)

(72) Inventor: Tobias Lechner, Uehlfeld (DE)

(73) Assignee: LECHNER GROUP GM BH, Frankfurt am Main (DE)

( * ) Notice: Subject to any disclaimer, the term of this patent is extended or adjusted under 35 U.S.C. 154(b) by 837 days.

(21) Appl. No.: 16/341,800

(22) PCT Filed: Oct. 19, 2017

(86) PCT No.: PCT/EP2017/076663
§ 371 (c)(1),
(2) Date: Sep. 19, 2019

(87) PCT Pub. No.: WO2018/073325
PCT Pub. Date: Apr. 26, 2018

(65) Prior Publication Data

US 2020/0024854 A1 Jan. 23, 2020

(30) Foreign Application Priority Data

Oct. 20, 2016 (DE) ..... 10 2016 120 047.6

(51) Int. Cl.
*E04G 11/02* (2006.01)
*E04B 1/348* (2006.01)
*B28B 7/30* (2006.01)

(52) U.S. Cl.
CPC ..... *E04G 11/02* (2013.01); *B28B 7/30* (2013.01); *E04B 1/34823* (2013.01)

(58) Field of Classification Search
CPC ..... E04G 11/02; E04G 11/08; E04G 11/082; E04G 11/20; E04G 1/02; E04G 1/04;
(Continued)

(56) References Cited

U.S. PATENT DOCUMENTS 3,932,082 A 1/1976 Beaman
4,890,999 A 1/1990 Del Monte

FOREIGN PATENT DOCUMENTS

CN 2049653 U 12/1989
CN 2207418 Y 9/1995
(Continued)

OTHER PUBLICATIONS

Chinese Office Action issued in connection with Chinese Patent Application No. 201780063480.8 dated Jun. 28, 2020.
(Continued)

*Primary Examiner* — Stella K Yi
(74) *Attorney, Agent, or Firm* — Dennemeyer & Associates, LLC

(57) ABSTRACT

The invention relates to an apparatus for the one-piece production of a room module (8) having three side elements (24) and a floor element (25) and/or a ceiling element (26), wherein the apparatus takes the form of a parallelepipedal and hollow core formwork (10) around which an outer formwork (9) for the room module (8) to be produced can be arranged. The following are provided here: a) a rectangular head element (11) which consists of first planar elements (1) and second planar elements (2), b) side elements (12, 13, 14, 15) which consist of a third planar elements (3) and fourth planar elements (4) and are arranged perpendicular to the head element (11) in the edge regions thereof, wherein at least the third planar elements (3) or the fourth planar elements (4) have corner regions (17) of the side elements (12, 13, 14, 15), c) the first planar elements (1) can be
(Continued)

lowered under the second planar elements (2) of the head element (11) and can be displaced with respect to one another and, subsequently, the second planar elements (2) can be pushed together with a reduction of the rectangular area of the head element (11), and d) the third planar elements (3) and fourth planar elements (4), which are arranged perpendicular to the head element (11), of the side elements (12, 13, 14, 15) can then be moved in succession in the direction of a centre longitudinal axis (16) of the head element (11) or the core formwork (10).

12 Claims, 10 Drawing Sheets

(58) Field of Classification Search
CPC .. E04G 1/16; E04G 1/162; B28B 7/22; B28B 7/30; B28B 7/34
See application file for complete search history.

(56) References Cited

FOREIGN PATENT DOCUMENTS

| | | | |
|---|---|---|---|
| CN | 1796706 | A | 7/2006 |
| CN | 101375010 | A | 2/2009 |
| CN | 102535846 | A | 7/2012 |
| CN | 103097621 | A | 5/2013 |
| CN | 205242996 | U | 5/2016 |
| CN | 105643774 | A | 6/2016 |
| DE | 6944097 | U | 4/1971 |
| DE | 2601287 | A1 | 7/1977 |
| DE | 102007019406 | A1 | 5/2008 |
| FR | 2031378 | A1 | 11/1970 |

OTHER PUBLICATIONS

European Patent Office, International Search Report with the Written Opinion of the International Searching Authority, dated Feb. 7, 2018, World Intellectual Property Office, Rijswijk.

APPARATUS AND METHOD FOR THE ONE-PIECE PRODUCTION OF A ROOM MODULE HAVING THREE SIDE ELEMENTS AND A FLOOR ELEMENT AND/OR A CEILING ELEMENT, AND ROOM MODULE OF THIS TYPE

CROSS-REFERENCE TO RELATED APPLICATIONS

This is a 35 U.S.C. 371 National Stage Patent Application of International Application No. PCT/EP2017/076663, filed Oct. 19, 2017, which claims priority to German application 10 2016 120 047.6, filed Oct. 20, 2016, each of which is hereby incorporated by reference in its entirety.

BACKGROUND

Description: An apparatus and a method for the one-piece production of a room module comprising three side elements as well as a base element and/or a ceiling element, and such a room module.

The invention relates to an apparatus and a method for the one-piece production of a room module comprising three side elements as well as a base element and/or a ceiling element. Furthermore, the invention relates to such a room module.

DE 10 2008 045 394 A1 discloses an industrially prefabricated room cell for a building of modular design. Said room cell has at least two adjoining walls and a base element connected thereto. In the case of such room cells, it is still necessary to produce the individual walls and the base element separately and then connect them to each other.

Furthermore, EP 1 207 238 A2 discloses a prefabricated transportable room cell which consists of a base plate, a ceiling plate and side walls in a monolithic composite. However, these individual side walls, the base plate and the ceiling plate are manufactured separately and connected to each other, for example via grooves and springs, to form the room cell. For producing such side walls, base plates and ceiling plates, different apparatuses are necessary so that they can be finally joined together to form a corresponding room cell.

A similar room cell is known from DE 103 26 777 A1. First, a base plate is produced, on which a monolithic hollow body comprising the walls and the ceiling is mounted and connected thereto.

U.S. Pat. No. 4,614,326 A discloses an apparatus and method for the one-piece production of a concrete element comprising three side elements as well as a base element and a ceiling element. The apparatus in said document is formed as a cuboid core formwork, around which an outer formwork for the room module to be produced can be arranged. The core formwork consists of a head element and four side elements arranged perpendicular thereto. The side elements are formed from surface elements that can be moved successively in the direction of a central longitudinal axis of the core formwork. In addition, the surface elements are formed in such a way that the head element is lowered by gravity during its movement in the direction of the central longitudinal axis, whereas it is raised from the central longitudinal axis during a movement of the surface elements. The problem here is that after the apparatus has been filled with concrete and cured, the head element adheres to the cured concrete and is not lowered in the direction of the central longitudinal axis of the core formwork in spite of the displacement of the surface elements. In the subsequent attempt to detach the head element from the concrete, there is thus a risk that the concrete element produced will be damaged unintentionally immediately after its manufacture.

FR 2 031 378 A1 discloses a formwork device for the construction of known concrete structures. The formwork device has two end elements and a central element.

DE 26 01 287 A1 discloses a system and a method for producing concrete room cells is known, consisting of three walls and two plates, the base and the ceiling. The system consists of two tiltable, heated outer formwork sets and a mould core, which is movable in two directions between said outer formwork sets and is coaxially arranged between said two outer formwork sets. Each set of the outer formworks consists of the base formwork, which is attached on a platform, the tiltable side wall formworks and a removable heat shield, which is provided with a calibrating frame. The mould core consists of a movable metal frame which can be moved in two directions, a carrier which can be rolled in said two directions and a displaceable set of inner formworks, which is attached on the metal frame.

There is the same problem of adherence of the cured concrete to a head element after its curing in the apparatus and the method for producing monolithic room cells according to DE 28 45 106 A1.

It is therefore an aim of the invention to provide an apparatus and a method for the one-piece production of a room module comprising three side elements as well as a base element and/or a ceiling element. Furthermore, it is an aim of the invention to provide such a one-piece room module.

According to the apparatus, this aim is achieved by an apparatus having all the features of patent claim 1. According to the method, this aim is achieved by a method having all features of patent claim 9. Advantageous embodiments of the invention can be found in the dependent claims.

The apparatus according to the invention for the one-piece production of a room module comprising three side elements and a base element and/or a ceiling element, wherein the apparatus is formed as crater-like and hollow core formwork around which an outer formwork for the room module to be produced can be arranged, comprising the following features:

a) A rectangular head element consisting of first and second surface elements;

b) side elements which are arranged perpendicular to the head element in its edge regions and consist of third and fourth surface elements, wherein at least the third or the fourth surface elements have corner regions of the side elements;

c) the first surface elements can be lowered below the second surface elements of the head element and are displaceable relative to one another, and subsequently the second surface elements can be pushed together so as to reduce the rectangular area of the head element, and d) the third and fourth surface elements, arranged perpendicular to the head element, of the side elements can be moved successively in the direction of a central longitudinal axis of the head element or the core formwork.

The invention now provides a core formwork, around which an outer formwork can be arranged, wherein a metal reinforcement, in particular a steel reinforcement, can be arranged between the core formwork and the outer formwork so that a curable compound can be inserted between the outer formwork and the core formwork and the one-piece room module is formed between the outer formwork and the core formwork.

Particularly in the manufacture of garages, it has proven successful to use concrete as a curable compound, so the apparatus according to the invention can be used to easily produce one-piece garage modules as room modules, which already have a ceiling plate, a base plate and three side walls. A garage door can then be arranged in the opening of the open wall of such a garage module However, it is also possible to produce such room modules only with three side walls and a base plate or ceiling plate so that they can be stacked on above the other and a ceiling plate of a lower room module acts as a base plate of an upper room module or a base plate of an upper room module as a ceiling plate of a lower room module.

As soon as the curable compound, in particular the concrete, between the outer formwork and the core formwork has cured, the outer formwork can be removed.

The fundamental problem that then exists and is solved according to the invention is that the core formwork must be removed from the cuboid-hardened room module. First the first surface elements of the head element of the core formwork are moved below the second surface elements of the head element of the core formwork and then relative to one another in such a way that they move away from the edge of the head element of the core formwork towards its centre. Subsequently, the second surface elements of the head element of the core formwork can also be moved relative to one another so that the rectangular area of the head element is reduced. In this state, the side elements of the core formwork, consisting of third and fourth surface elements, are no longer located in the edge region of the head element since the second surface elements are now displaced inwards so as to reduce the rectangular area of the head element. In this respect, there is now a gap between the side elements of the core formwork and its head element with a reduced rectangular area. This gap makes it possible to move the third and fourth surface elements of the side elements successively in the direction of the central longitudinal axis of the head element or the core formwork. The gap then no longer exists between the side elements and the head element of the core formwork, but between the side elements of the core formwork and the side elements or the base element and/or the ceiling element of the room module to be produced. As the first and second surface elements of the head element have already been moved, the head element still abuts the room module, but is already detached therefrom. In this state, the core formwork is no longer attached to the manufactured room module, so the core formwork can be easily removed from the manufactured room module.

BRIEF DESCRIPTION

The method according to the invention for the one-piece production of a room module comprising three side elements and a base element and/or a ceiling element has the following method steps:

a) providing a cuboid and hollow core formwork in a vertical position, in which a rectangular head element forms the upper boundary of the core formwork, on the edge regions of which side elements are arranged,
b) arranging an outer formwork around the cuboid and hollow core formwork to form an intermediate space between the outer formwork and the core formwork,
c) filling the intermediate space with a curable compound,
d) curing the compound,
e) removing the outer formwork,
f) lowering first surface elements below second surface elements of the head element and displacing the first surface elements relative to one another in the direction of the centre of the head element and pushing together the second surface elements so as to reduce the rectangular area of the head element,
g) displacing third and fourth surface elements arranged perpendicular to the head element in the direction of a central longitudinal axis of the head element or of the core formwork, and
h) removing the core formwork from the finished room module by means of a displacement device.

By means of the apparatus and method according to the invention, it is now possible to produce one-piece room modules, in particular one-piece garage modules, which only have to be provided with a corresponding garage door. It is no longer necessary to connect the individual side walls or the base and ceiling plates separately to the side walls since these are already connected to each other in one piece using the apparatus according to the invention and the method according to the invention.

According to the method according to the invention, it is possible for installation elements, such as electrical lines, freshwater and sewage lines, heating pipes and other sanitary facilities, free spaces for windows and doors, empty conduits and the like to be arranged on the core formwork before an outer formwork is arranged. This has the particular advantage that such installation elements no longer have to be arranged in the room module later, which usually also causes damage to the individual walls or ceiling and/or base plates.

Particularly when concrete is used as a curable compound, it has proven to be advantageous for a reinforcement to be mounted on the core formwork before arranging an outer formwork. In such a reinforcement using concrete as a curable compound, usually a metal, in particular a steel, reinforcement is recommended.

According to a first advantageous embodiment of the apparatus according to the invention, a displacement device is provided within the hollow core formwork, by means of which the surface elements can be moved. This measure makes it possible in a simple manner to provide such a displacement device for the individual surface elements and to arrange it within the cavity of the core formwork, which is otherwise not used or where otherwise an apparatus for stabilising the core formwork has to be provided. Such a displacement device is therefore not only used to remove the corresponding surface elements from the room module after it is cured. Rather, such a displacement device also provides a stabilising element which holds the surface elements in the corresponding position during hardening of the curable compound, in particular the concrete, against the pressure of the compound which has not yet cured, until the compound has cured.

It has also proven to be advantageous for the displacement device to be designed for mechanical, electrical, pneumatic and/or hydraulic displacement of the surface elements. Many kinds of such displacement devices are known and can be integrated in a simple manner in the cuboid, hollow core formwork so that it ensures both the stability function while the curable compound cures and the subsequently required displacement of the individual surface elements, for example via a corresponding lever mechanism.

According to a further advantageous embodiment of the invention, it has proven successful for the first surface elements of the head element to be formed as diagonal struts extending from its centre to its corners. Such diagonal struts can easily be lowered below the second surface elements of the head element and moved relative to one another so that a corresponding gap is even formed between these diagonal struts and the side elements of the core formwork in the corner regions of the head element. Subsequently, it is easily possible to move the other surface elements of the head element relative to one another so as to reduce the rectangular area of the head element so that a circumferential gap is now formed between the head element and the side elements of the core formwork.

It is also advantageous that for lowering the first surface elements below the second surface elements of the head element a rotary element in the form of a head plate is provided and a guide system is provided for moving them relative to one another. Such a guide system can be formed, for example, from bolts arranged on the first surface elements of the head element with corresponding guide rails for said bolts within the core formwork.

When using diagonal struts as the first surface elements of the head element, it is further advantageous that the second surface elements are formed substantially as triangular elements and can be pushed together to reduce the rectangular area of the head element.

However, it is also conceivable to form the first and second surface elements differently. For example, the first surface elements can be formed as four crosswise-arranged struts extending outwards from the centre of the head element, and the second surface elements can be arranged as correspondingly arranged rectangular elements.

In order to separate the now cured room module, in particular the finished garage module, from the core formwork, a tilting device is provided, by means of which the core formwork can be tilted from a vertical to a horizontal position and vice versa. If the cured room module, in particular the finished garage module and therefore also the core formwork, is now in the horizontal position, a displacement device is provided by means of which the room module can be moved away from the core formwork or by means of which the core formwork can be pulled out or moved out of the room module.

The manufactured one-piece room module and the core formwork are now separated from each other so that the finished room module can be provided for its further use, while the core formwork is reusable for further production of such one-piece room modules.

Finally, a room module, in particular a garage module, produced using the method according to the invention and the apparatus according to the invention also has to be protected separately.

Further aims, advantages, features and possible applications of the present invention arise from the following description of exemplary embodiments with reference to the drawings. All features described and/or illustrated, either individually or in any meaningful combination, form the subject matter of the present invention, irrespective of their summary in claims or their back reference.

DETAILED DESCRIPTION

FIGS. 1 to 4 show an exemplary embodiment of an apparatus according to the invention for the one-piece production of a room module 8 comprising three side elements 24, a base element 25 and a ceiling element 26. The representation of the room module 8 was omitted in order to better illustrate the mode of operation of the apparatus according to the invention.

An exemplary embodiment of a production method of a room module according to the invention with an apparatus according to the invention, for example the apparatus of FIGS. 1 to 4, and a method according to the invention is shown schematically in FIGS. 7 to 13.

Figure 1:
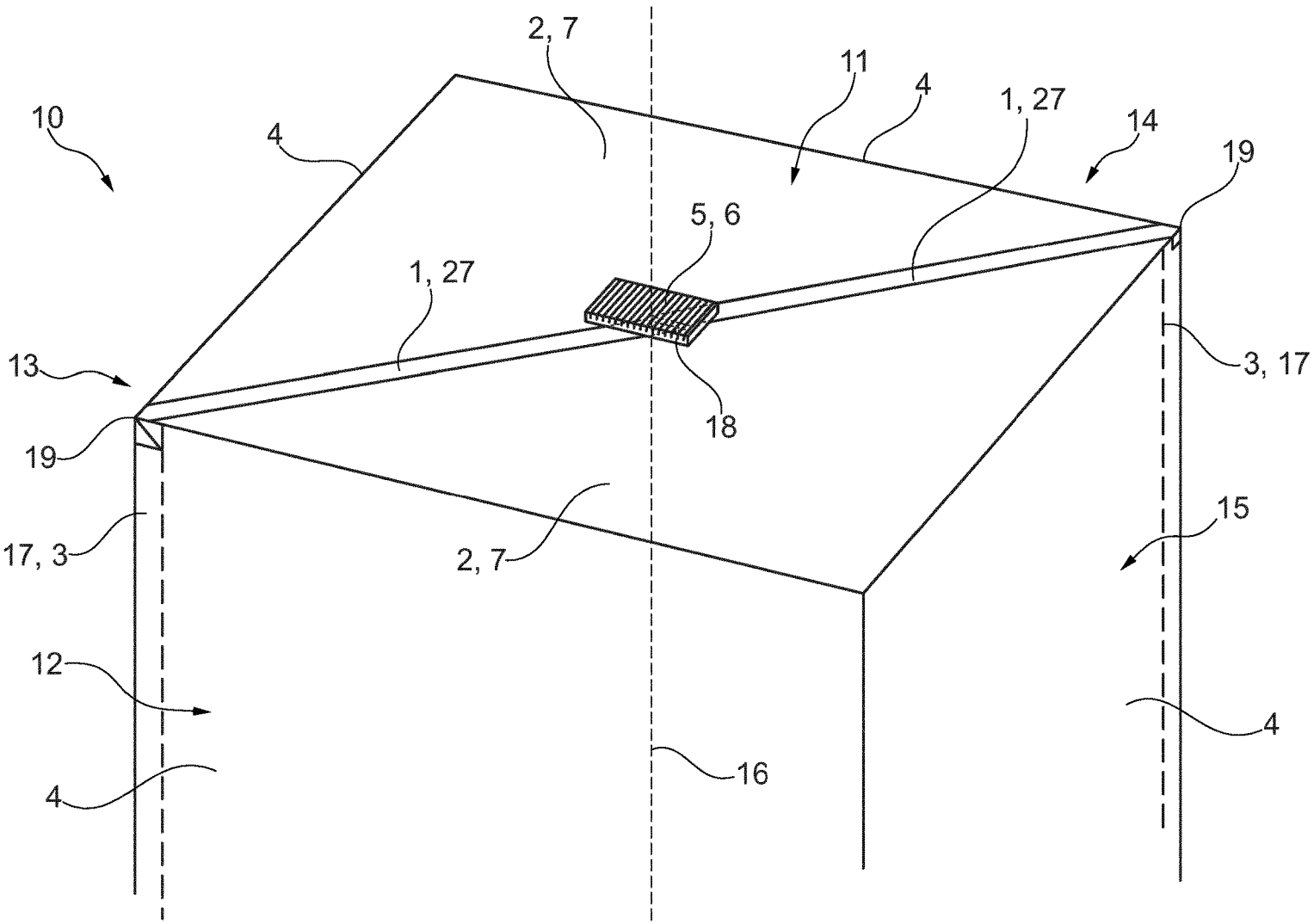
FIG. 1 shows a perspective view of a possible embodiment of an apparatus according to the invention for the one-piece production of a room module in a first position.
Figures 7, 8, 9:
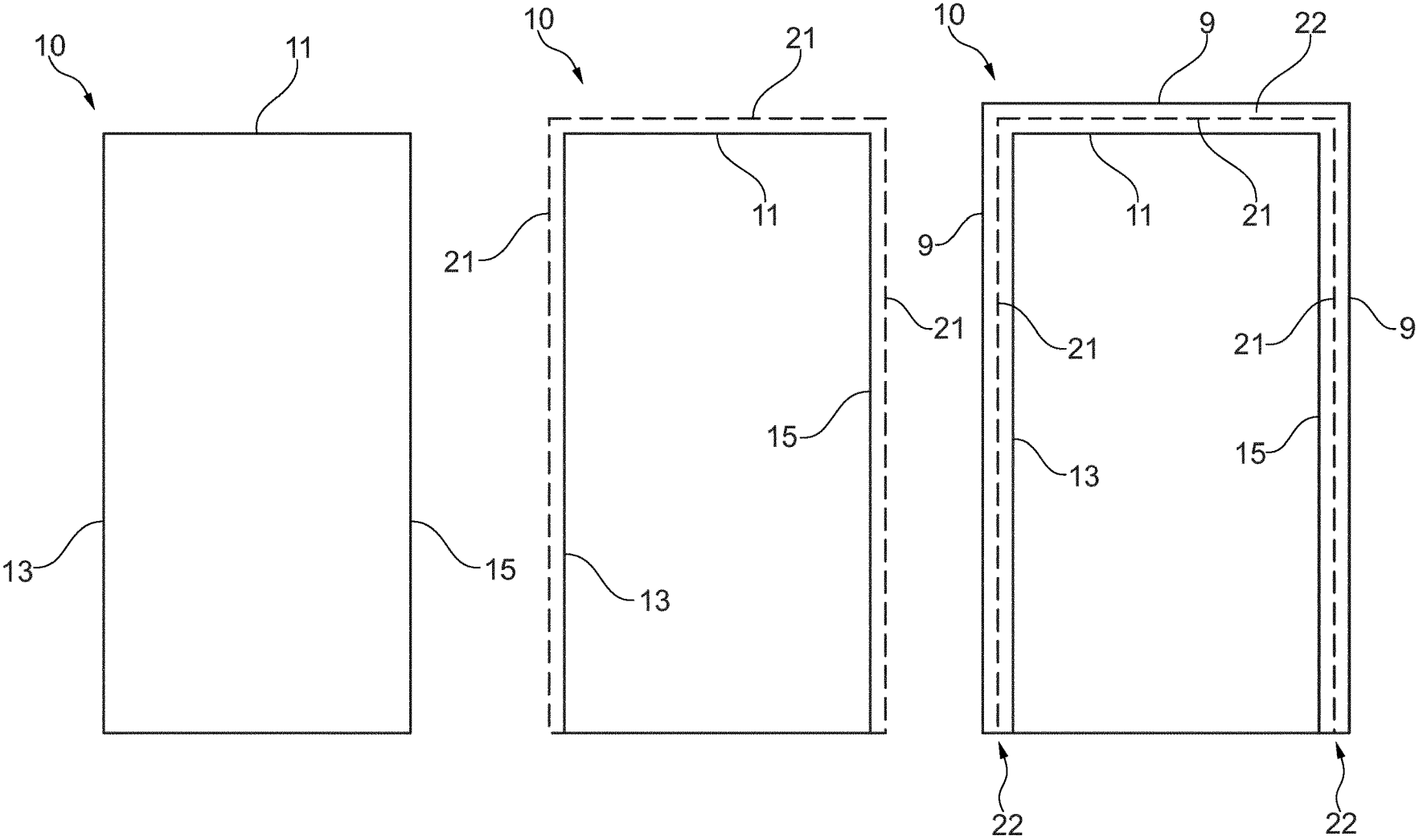
FIGS. 7 to 14 show a schematic representation of the production of a room module using an apparatus according to the invention and a method according to the invention in different sub-steps.

From FIG. 1 it can be seen that the apparatus according to the invention is formed as a cuboid and hollow core formwork 10, around which an outer formwork (not shown here), which is provided in FIG. 9 with the reference sign 9, can be arranged for the room module 8 to be produced. The core formwork 10 has a rectangular head element 11 consisting of first surface elements 1 and second surface elements 2. In the present exemplary embodiment, two first surface elements 1 are provided, which are formed as diagonal struts 27, extending from the centre 18 of the head element 11 to two corners 19 of the head element 11 and are angled substantially at right angles in the region of the corners 19. In this exemplary embodiment, the corresponding second surface elements 2 are formed as a triangular elements 7 so that the second surface elements 2, designed as triangular elements 7, together with the first surface elements 1, designed as diagonal struts 27, form the rectangular head element 11 according to FIG. 1.

Figure 2:
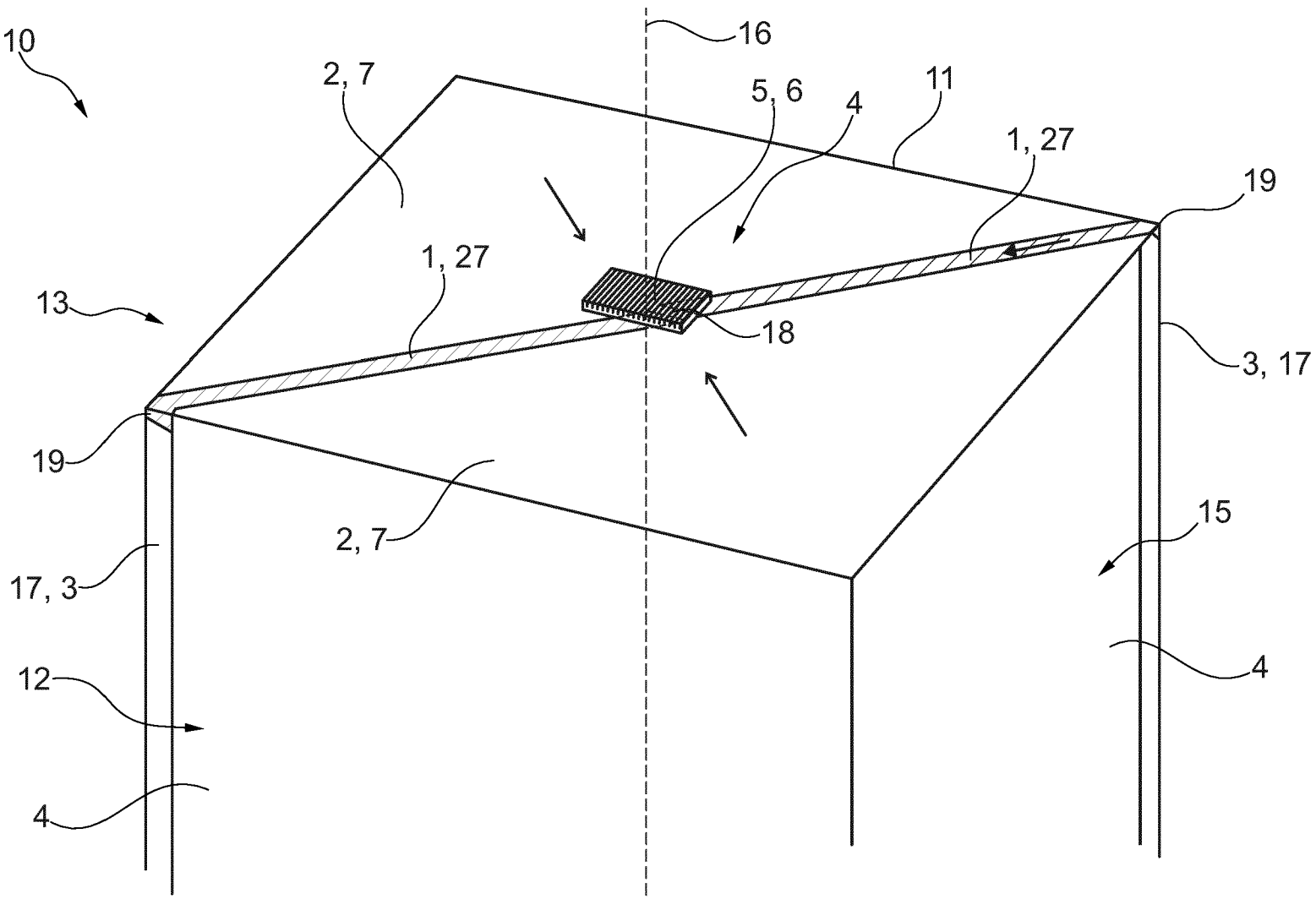
FIG. 2 shows a perspective view of the apparatus according to FIG. 1 in a second position.

Side elements 12, 13, 14 and 15 consisting of third surface elements 3 and fourth surface elements 4 are arranged perpendicular to the head element 11 in its edge regions, wherein in the present exemplary embodiment the third surface elements 3 have corner regions 17 of the side elements 12, 13, 14 and 15 and in the region of the corners 19 of the first surface elements 1, designed as diagonal struts 27, fit substantially flush with their right-angled regions According to the invention, the first surface elements 1 of the head element 11, which are designed as diagonal struts 27, can be lowered below the second surface elements 2 of the head element 11, which are designed as triangular elements 7, as indicated in FIG. 2 by the hatching of the first surface elements 1, designed as diagonal struts 27. During or after the lowering of the first surface elements 1, designed as diagonal struts 27, they are displaced relative to one another so that the corners 19 of the head element 11 are displaced inwardly in the direction of the centre 18 of the head element 11, as indicated in FIG. 2 by the arrows within the first surface elements 1. The first surface elements 1, designed as diagonal struts 27, can be moved in the direction of a head plate 5, designed as a turning device 6, in the centre 18 of the head element 11 via a hydraulic displacement device and a lever mechanism coupled therewith.

Figure 5:
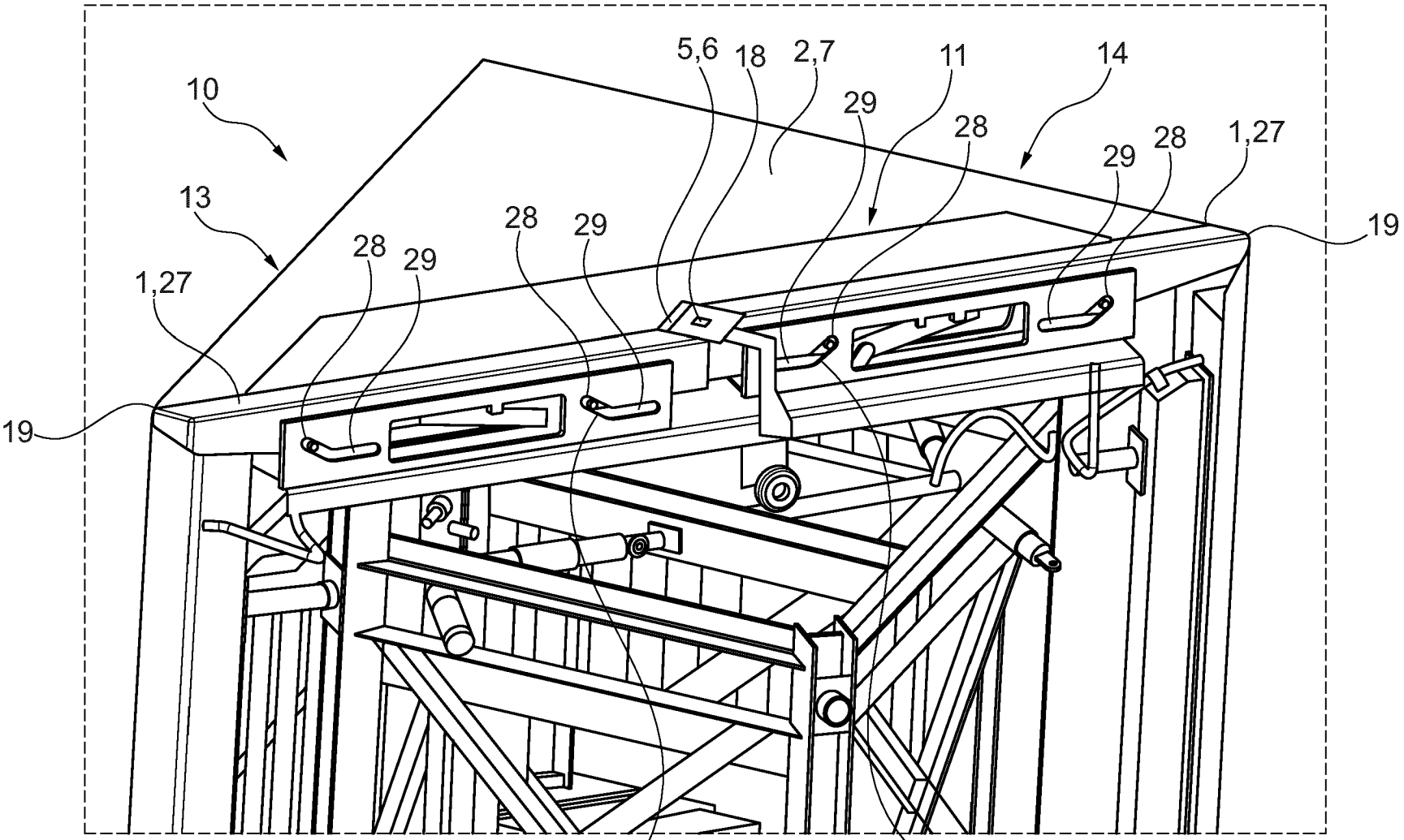
FIG. 5 shows a partial sectional view of an apparatus according to the invention which is in a first position according to FIG. 1.
Figure 6:
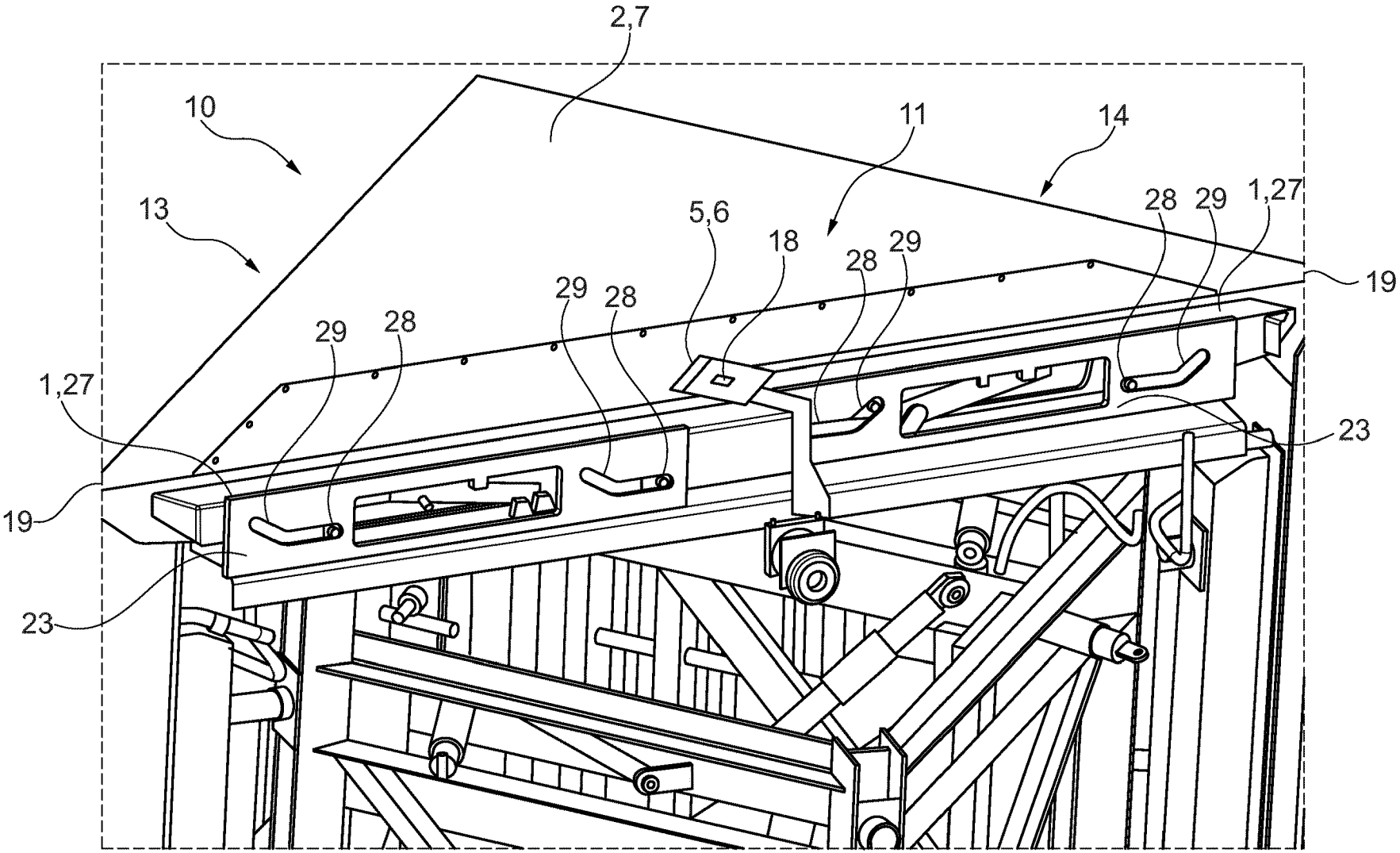
FIG. 6 shows the apparatus according to FIG. 5, which is in a second position according to FIG. 2.

They have bolts 28 for lowering the diagonal struts 27, which are guided in corresponding guide rails 29 of a guide system 23, as shown by way of example in FIGS. 5 and 6.

After the diagonal struts 27 and thus the first surface elements 1 of the head element 11 have been lowered, the second surface elements 2 of the head element 11, which are designed as triangular elements 7, can likewise be moved in the direction of a central longitudinal axis 16 of the core formwork 10, as indicated by the arrows on the triangular elements 7 in FIG. 2.

Figure 3:
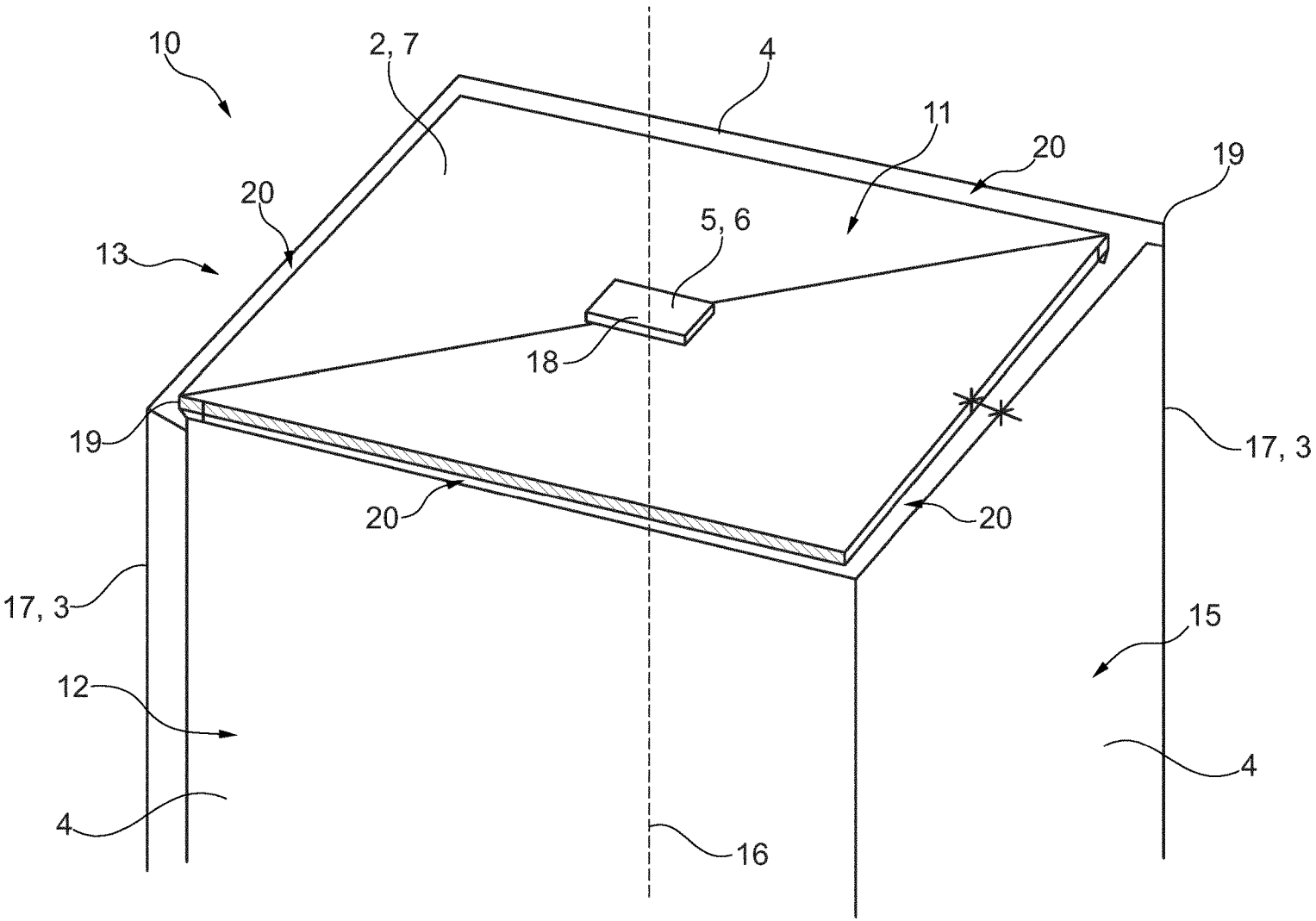
FIG. 3 shows a perspective view of the apparatus of FIG. 1 in a third position.

FIG. 3 shows a third position of the core formwork 10 according to the invention, in which the second surface elements 2, designed as triangular elements 7, are moved in the direction of the central longitudinal axis 16 of the core formwork 10. This ensures that the rectangular area of the head element 11 has been reduced and a gap 20 is formed between the edge regions of the head element 11 and the side surfaces 12, 13, 14 and 15 of the core formwork 10.

Figure 4:
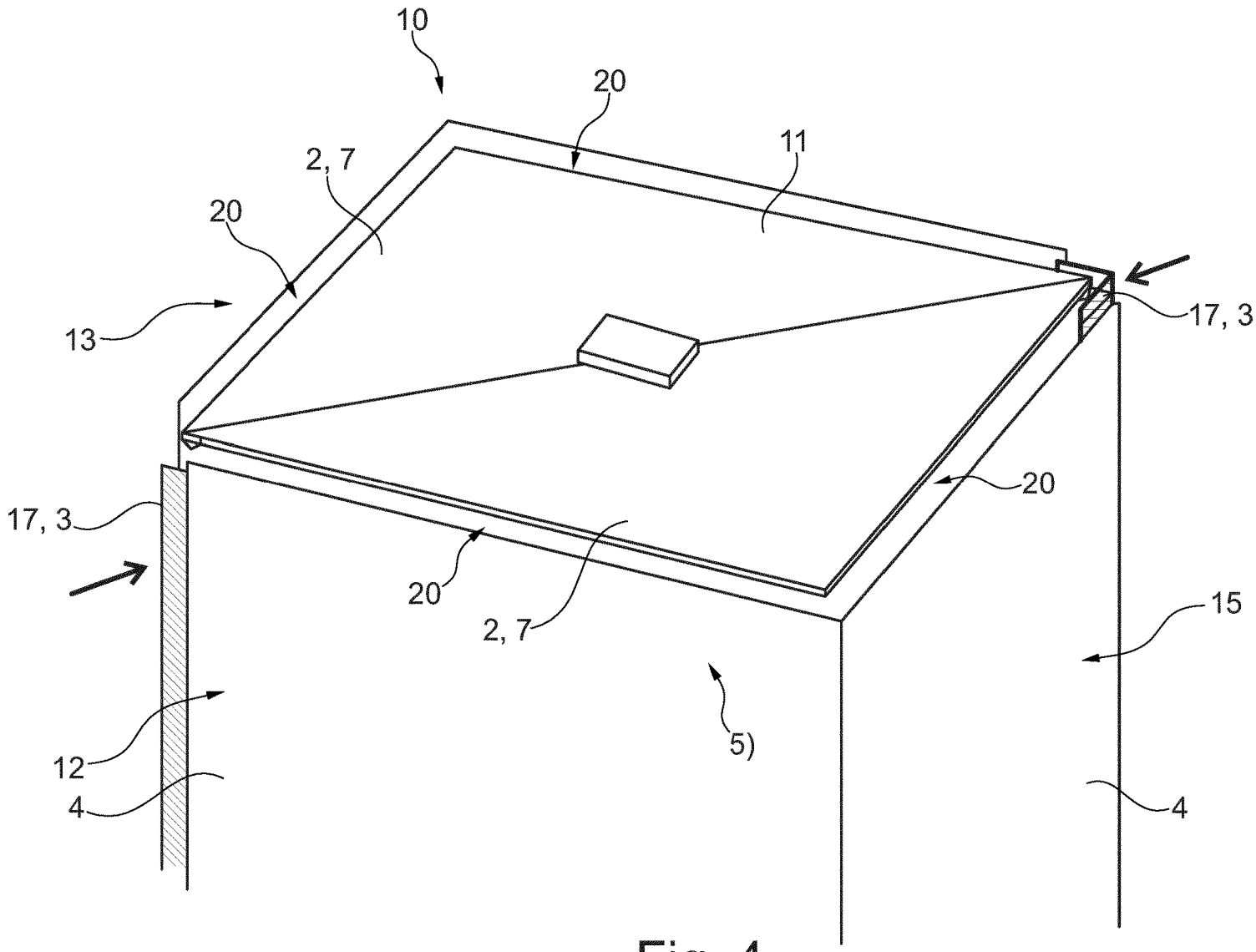
FIG. 4 shows a perspective view of the apparatus of FIG. 1 in a fourth position.

Owing to this gap 20, it is possible to move the third surface regions 3 of the core formwork, which are designed as corner regions 17, over their entire longitudinal extension, which also extends over the longitudinal extension of the core formwork 10, likewise in the direction of the central longitudinal axis 16 of the core formwork 10. This displacement of the third surface elements 3, designed as corner regions 17, is shown in FIG. 4, wherein this displacement is indicated by the arrows shown at the corner regions 17.

Finally, the fourth surface elements 4 can be moved in the direction of the central longitudinal axis 16 of the core formwork 10, so that the third and fourth surface elements 3 and 4 also adapt to the reduced rectangular area of the head element 11 of the core formwork 10.

As indicated above, FIGS. 5 and 6 show the inner workings of the core formwork 10 in a partially sectional view. Here, a lever mechanism (not shown in more detail) can be seen, which is designed to move the individual surface elements 1, 2, 3 and 4 accordingly by means of the hydraulic displacement device (also not shown in more detail). Furthermore, the hydraulic displacement device also ensures that the core formwork 10 withstands the pressure of a curable compound during its curing, thus ensuring the stability of the core formwork 10 and, ultimately, effective and uniform, repeatable production of a plurality of identical room modules 8.

FIGS. 7 to 14 schematically show the production of a room module 8 according to the invention in an apparatus, designed as a core formwork 10, according to the invention using a method according to the invention. In FIG. 7, the core formwork 10 is positioned vertically so that the head element 11 points upwards, and this sectional view shows the side elements 13 and 15 of the core formwork 10. The room module 8 to be produced is meant to be formed as a garage module having a base element 25, a ceiling element 26 and three side elements 24. In the production of such a room module 8, which is designed as a garage module, concrete is used as a curable compound. Therefore, it is necessary for the required stability of the garage module to incorporate reinforcement 21, preferably steel, within the concrete. As shown in FIG. 8, this reinforcement 21 is arranged around the core formwork 10 or around its side elements 12, 13, 14 and 15 and its head element 11.

After the reinforcement 21 has been arranged around the core formwork 10, this arrangement is now provided with an outer formwork 9, as shown in FIG. 9. It can be seen that an intermediate space 22 is formed between the core formwork 10 and its side elements 12, 13, 14 and 15 and its head element 11, and the reinforcement 21 is arranged within said intermediate space. In this case, an outer formwork 9 does not necessarily have to be arranged in the region of the head element 11 of the core formwork 10 since, owing to the vertical positioning of the core formwork 10, the concrete aligns itself parallel to the head element 11 of the core formwork according to gravity and only has to be smoothed there if necessary.

The intermediate space 22 is now filled with the curable compound, concrete in the present case, and in this position the entire apparatus according to the invention remains together with the outer formwork 9 and the not-yet-cured compound until it has cured.

Figure 10:
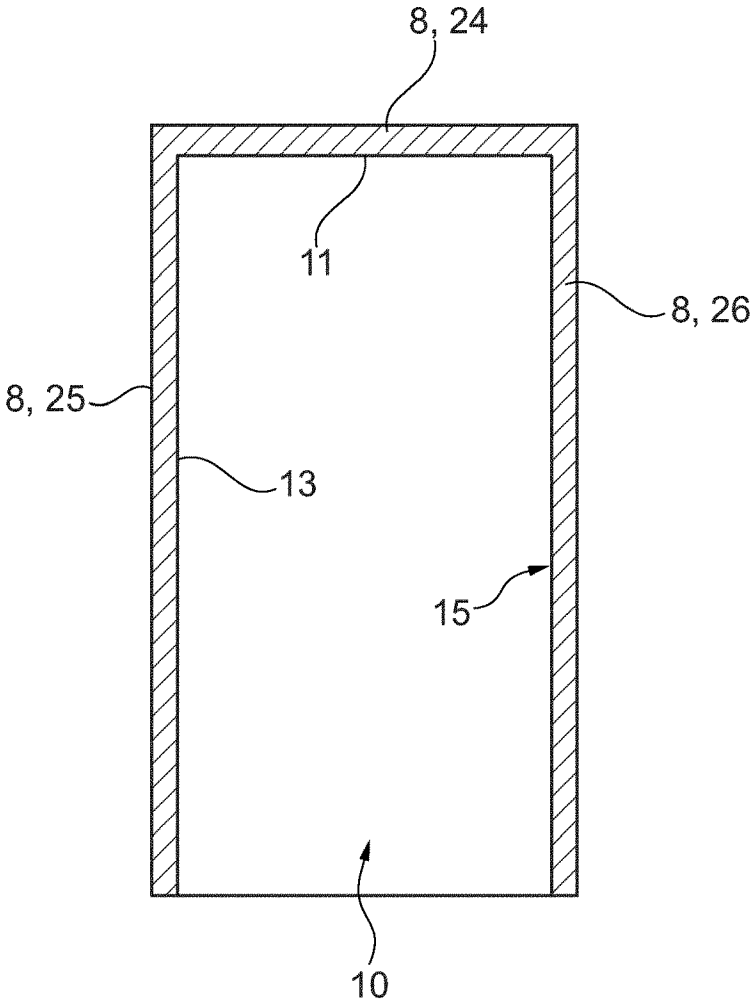

Once the compound or the concrete has cured, the outer formwork 9 can be removed. Once the concrete has cured, the room module 8, in the form of a garage module, is now formed. However, the core formwork 10 still has to be removed from the interior of the room module 8, in the form of a garage module. For this purpose, the vertically positioned room module 8, as shown in FIG. 10, is tilted by means of a tilting device (not shown) so that the room module 8 comes to rest on its base plate 25. In this position, the core formwork 10 is now no longer vertically, but horizontally positioned, as shown in FIG. 11.

Figure 11:
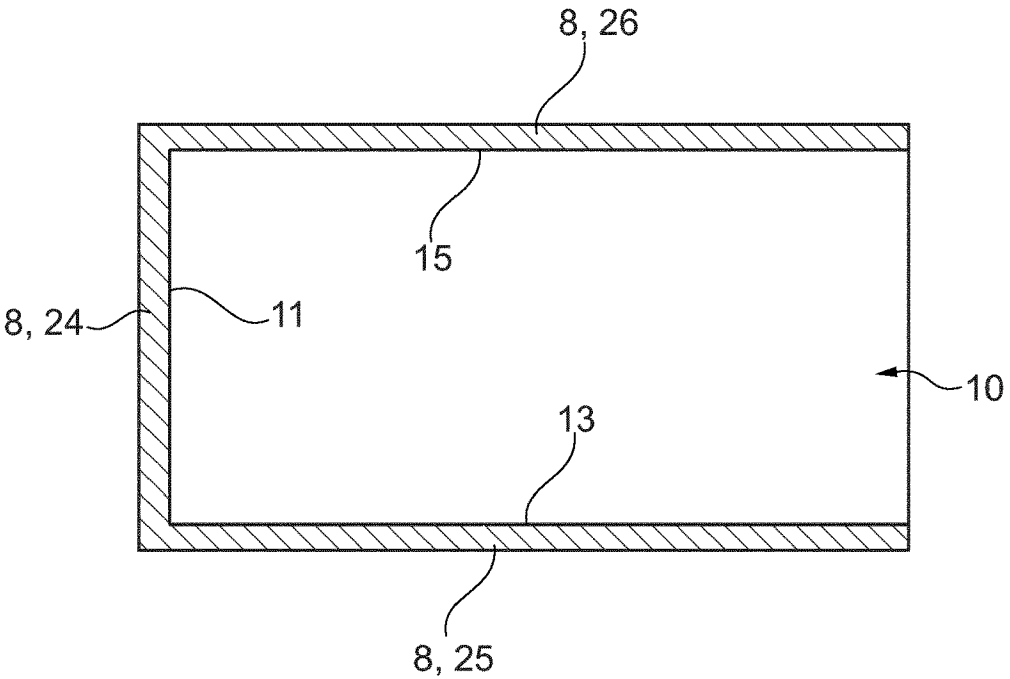
Figure 12:
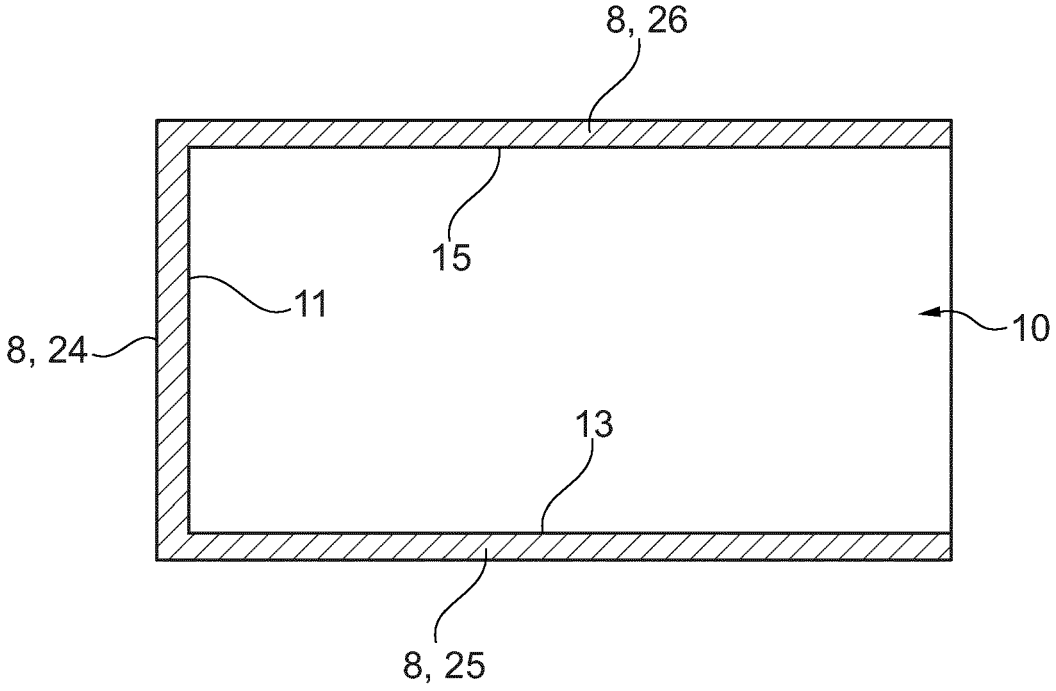

In the position according to FIG. 11, the first surface elements 1 of the head element 11 of the core formwork 10 are now lowered and moved relative to one another, and then the second surface elements 2, formed as triangular elements 27, are also moved relative to one another so as to reduce the rectangular area of the head element 11. The reduced rectangular area of the head element 11 is indicated in FIG. 12 by the thicker lines in relation to the room module 8 or its side wall 24.

Figure 13:
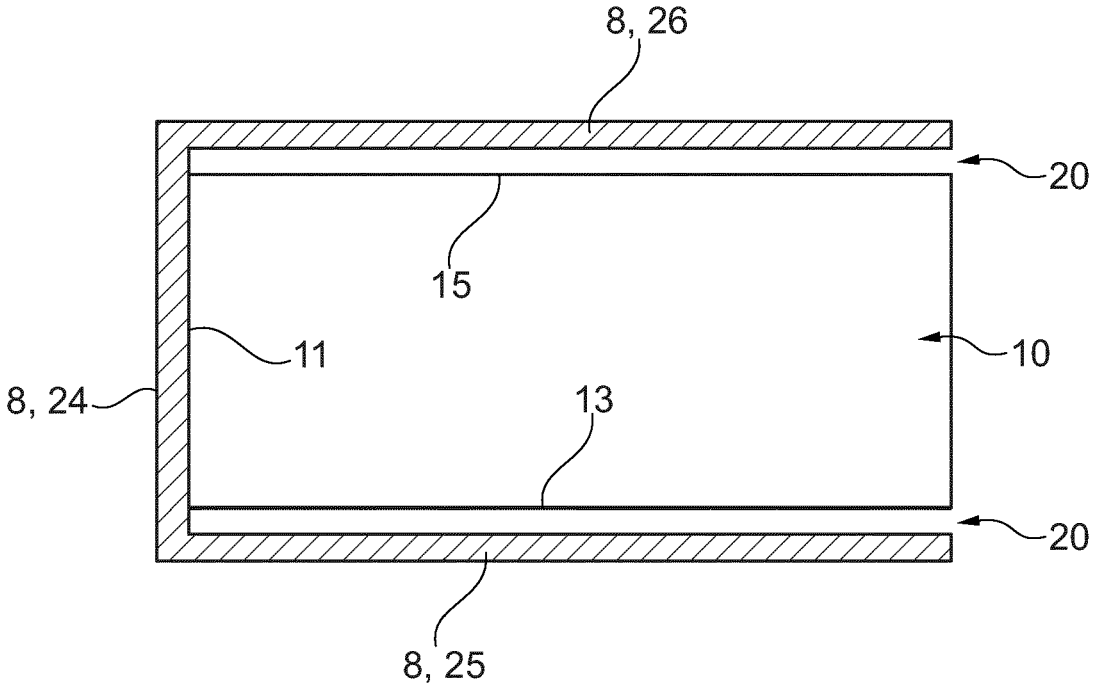
Figure 14:
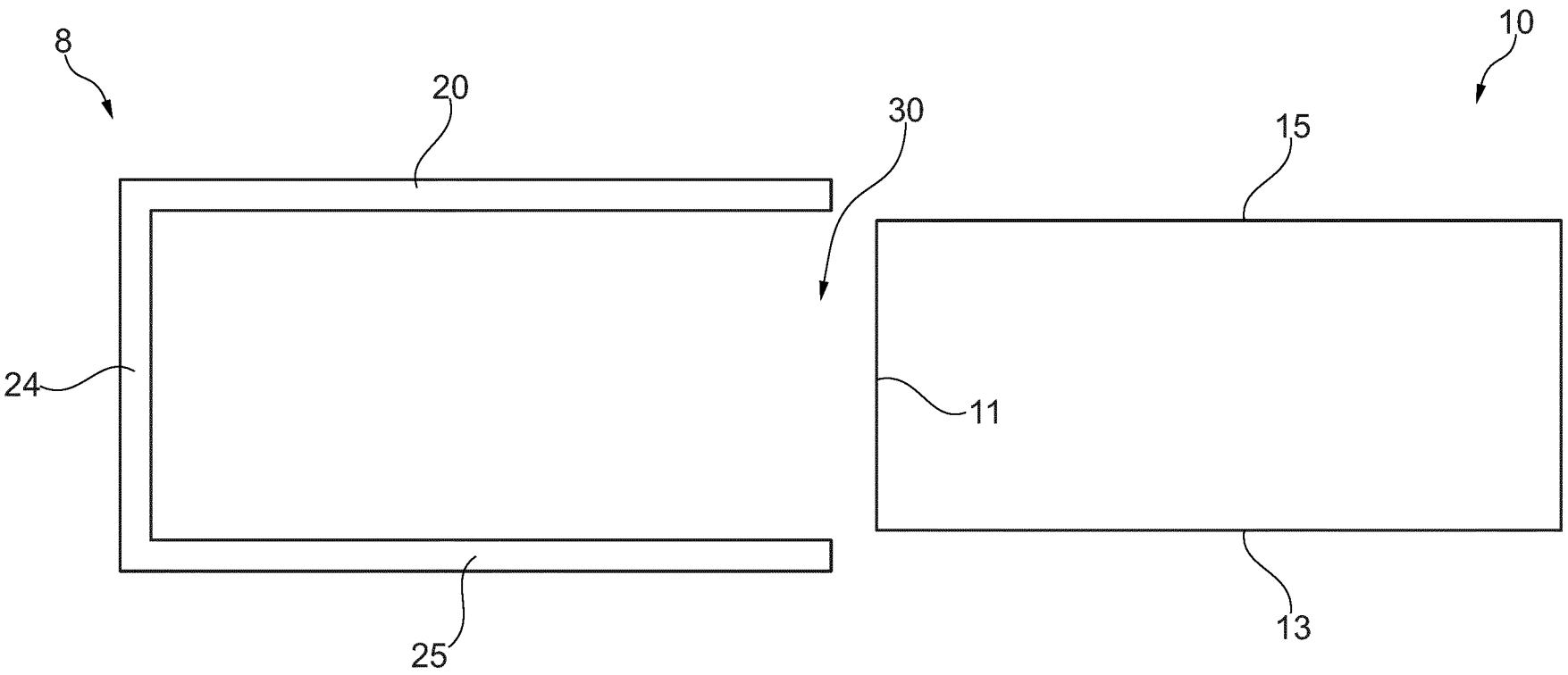

Subsequently, the third and fourth surface elements 3 and 4 of the core formwork 10 are adapted to the reduced rectangular area of the head element 11 by being moved in the direction of the central longitudinal axis 16 of the core formwork 10, as shown in FIG. 13. As a result, a gap 20 is formed in the region of the side elements 12, 13, 14 and 15 between the core formwork 10 and the room module 8 so that the core formwork 10 can be moved out of the interior of the room module 8. This is schematically shown in FIG. 14.

The room module 8, in the form of a garage module, thus produced can now be provided for further processing or use, and the core formwork 10 can be used to produce further room modules 8.

The room module 8 in this case has a base element 25, a ceiling element 26 and three side elements 24, i.e. now five surfaces. At the opening 30 of the room module 8, in the form of a garage module, a garage door can be arranged as the surface closing the room module 8, so, apart from this arrangement of the garage door, no further processing steps are necessary to produce a finished garage.

LIST OF REFERENCE SIGNS

1 Surface element
2 Surface element
3 Surface element
4 Surface element
5 Head plate
6 Turning device
7 Triangular element
8 Room module

9 Outer formwork
10 Core formwork
11 Head element
12 Side element
13 Side element
14 Side element
15 Side element
16 Central longitudinal axis
17 Corner region
18 Centre
19 Corner
20 Gap
21 Reinforcement
22 Intermediate space
23 Guide system
24 Side element
25 Base element
26 Ceiling element
27 Diagonal strut
28 Bolt
29 Guide rail
30 Opening

The invention claimed is:

1. An apparatus for the one-piece production of a room module (8) having three side elements (24) as well as a base element (25) and/or a ceiling element (26), wherein the apparatus is designed as a cuboid, hollow core formwork (10) around which an outer formwork (9) for the room module (8) to be produced can be arranged, which has the following features:

a) a rectangular head element (11) consisting of first surface elements (1) and second surface elements (2);
b) side elements (12, 13, 14, 15) which are arranged perpendicularly to the rectangular head element (11) in the edge regions thereof and consist of third surface elements (3) and fourth surface elements (4), wherein at least the third surface elements (3) or the fourth surface elements (4) have corner regions (17) of the side elements (12, 13, 14, 15);
c) the first surface elements (1) can be lowered below the second surface elements (2) of the head element (11) and be displaced relative to one another, and subsequently the second surface elements (2) can be pushed together so as to reduce the rectangular area of the rectangular head element (11), and
d) the third surface elements (3) and fourth surface elements (4), arranged perpendicular to the rectangular head element (11), of the side elements (12, 13, 14, 15) can be moved successively in the direction of a central longitudinal axis (16) of the rectangular head element (11) or of the hollow core formwork (10).

2. The apparatus according to claim 1, wherein within the hollow core formwork (10) a displacement device is provided, by means of which the first surface elements (1), second surface elements (2), third surface elements (3), and fourth surface elements (4) are movable.

3. The apparatus according to claim 2, wherein the displacement device is formed for mechanical, electrical, pneumatic and/or hydraulic displacement of the first surface elements (1), second surface elements (2), third surface elements (3), and fourth surface elements (4).

4. The apparatus according to claim 1, wherein the first surface elements (1) of the rectangular head element (10) are formed as diagonal struts (6) extending from a center (18) of said rectangular head element to corners (19).

5. The apparatus according to claim 1, wherein for lowering the first surface elements (1) below the second surface elements (2) of the rectangular head element (11) a rotary element (6) in form of a head plate (5) is provided, and a guide system (23) is provided for a displacement relative to one another.

6. The apparatus according to claim 1, wherein the second surface elements (2) are formed substantially as triangular elements (7) and can be pushed together so as to reduce the rectangular area of the rectangular head element (11).

7. The apparatus according to claim 1, wherein a tilting device is provided, by means of which the hollow core formwork (10) can be tilted from a vertical position to a horizontal position and vice versa.

8. The apparatus according to claim 1, wherein a displacement device is provided, by means of which the room module (8) can be moved away from the hollow core formwork (10) or by means of which the hollow core formwork (10) can be pulled or moved out of the room module.

9. A method for the one-piece production of a room module (8) having three side elements and a base element and/or a ceiling element, comprising the following method steps:

a) providing a cuboid and hollow core formwork (10) in a vertical position, in which a rectangular head element (11) forms an upper boundary of the core formwork (10), on edge regions of which side elements (12, 13, 14, 15) are arranged,
b) arranging an outer formwork (9) around the cuboid and hollow core formwork (10) to form an intermediate space (22) between the outer formwork (9) and the hollow core formwork (10),
c) filling the intermediate space (22) with a curable compound,
d) curing the curable compound,
e) removing of the outer formwork (9),
f) lowering first surface elements (1) below second surface elements (2) of the rectangular head element (11) and displacing the first surface elements (1) relative to one another in direction of the center (18) of the rectangular head element (11) and pushing the second surface elements (2) together so as to reduce the rectangular area of the rectangular head element (11),
g) displacing third surface elements (3) and fourth surface elements (4) arranged perpendicular to the rectangular head element (11) in direction of a central longitudinal axis (16) of the rectangular head element (11) or of the hollow core formwork (10), and
h) removing the hollow core formwork from a finished room module (8) by means of a displacement device.

10. The method according to claim 9, wherein, prior to arranging an outer formwork (9), installation elements, such as electrical lines, freshwater and sewage lines, open spaces for windows and doors, conduits and the like are arranged on the hollow core formwork.

11. The method according to claim 9, wherein, prior to arranging an outer formwork (9), a reinforcement (21) is mounted on the hollow core formwork.

12. A room module (8) produced by a method according to claim 9 and/or an apparatus according to claim 1.

* * * * *